US010704854B1

(12) United States Patent
Bender

(10) Patent No.: US 10,704,854 B1
(45) Date of Patent: Jul. 7, 2020

(54) FIREARM DELAY MECHANISM

(71) Applicant: In Ovation LLC, Vadnais Heights, MN (US)

(72) Inventor: Terrence Dwight Bender, Minneapolis, MN (US)

(73) Assignee: In Ovation LLC, Vadnais Heights, MN (US)

( * ) Notice: Subject to any disclaimer, the term of this patent is extended or adjusted under 35 U.S.C. 154(b) by 0 days.

(21) Appl. No.: 16/258,542

(22) Filed: Jan. 26, 2019

(51) Int. Cl.
*F41A 3/78* (2006.01)
*F41A 19/16* (2006.01)
*F41A 7/00* (2006.01)

(52) U.S. Cl.
CPC ..... *F41A 19/16* (2013.01); *F41A 3/78* (2013.01); *F41A 7/00* (2013.01)

(58) Field of Classification Search
CPC ..... F41A 3/78; F41A 3/84; F41A 3/82; F41A 3/86; F41A 3/80
USPC ..... 42/1.06; 89/198
See application file for complete search history.

(56) References Cited

U.S. PATENT DOCUMENTS 813,802 A * 2/1906 Johnson ..... F41A 3/78 89/198

* cited by examiner

*Primary Examiner* — Reginald S Tillman, Jr.
(74) *Attorney, Agent, or Firm* — Vidas, Arrett & Steinkraus

(57) ABSTRACT

In some embodiments, a firearm mechanism comprises a bolt carrier comprising a bolt carrier cavity, a buffer comprising a buffer cavity and a weight arranged to travel between the bolt carrier cavity and the buffer cavity. The buffer cavity comprises a damping mechanism comprising a reduction in a cross-sectional size of the buffer cavity. In some embodiments, the damping mechanism and weight comprise a valve arrangement arranged to pressurize the buffer cavity and damp kinetic energy carried by the weight.

19 Claims, 5 Drawing Sheets

FIREARM DELAY MECHANISM

BACKGROUND OF THE INVENTION

This invention relates to automatic machine guns and fire control mechanisms.

Automatic repeating firearms generally have high firing rates. For example, M4 and M16 machine guns can fire 700-900 or more rounds per minute. While a high firing rate has certain benefits, there can be drawbacks such as decreased accuracy and increased ammunition consumption.

There remains a need for firearm mechanisms having variable rates of fire. There remains a need for novel firearm mechanisms, and a need for mechanisms that can slow the firing rate of available automatic firearms.

It has been discovered that ambient conditions and firearm accessories can impact the cycle rate of firearm action mechanisms. For example, barrel muzzle attachments will often trap more heat in the action mechanism and increase firing rate. There remains a need for firearm mechanisms that are less pervious to cycle rate change due to conditions and accessories.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below. A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, a firearm mechanism comprises a bolt carrier comprising a bolt carrier cavity, a buffer comprising a buffer cavity and a weight arranged to travel between the bolt carrier cavity and the buffer cavity. The buffer cavity comprises a damping mechanism comprising a reduction in a cross-sectional size of the buffer cavity.

In some embodiments, the damping mechanism and weight comprise a valve arrangement arranged to pressurize the buffer cavity.

In some embodiments, the damping mechanism comprises a taper.

In some embodiments, the reduction in the cross-sectional size is continuous along a length of the damping mechanism. In some embodiments, a rate of the reduction in the cross-sectional size is constant along a length of the damping mechanism.

In some embodiments, the buffer cavity comprises a first portion, a second portion and a third portion. In some embodiments, the second portion comprises the reduction in the cross-sectional size. In some embodiments, the first and third portions are each cylindrical and comprise different cross-sectional areas. In some embodiments, a cross-sectional shape of the buffer cavity is constant.

In some embodiments, a firearm mechanism comprises a bolt carrier comprising a bolt carrier cavity, a buffer comprising a buffer cavity and a weight arranged to travel between the bolt carrier cavity and the buffer cavity. The buffer cavity comprises a tapered portion.

In some embodiments, the tapered portion and weight comprise a valve arrangement arranged to pressurize the buffer cavity.

In some embodiments, a firearm buffer comprises a body comprising a sidewall defining a cavity, and the cavity comprises a first length portion, a second length portion and a third length portion. The third length portion comprises a cross-sectional area that is less than a cross-sectional area of the first length portion. The second length portion comprises a reduction in cross-sectional area.

In some embodiments, the sidewall of the second length portion comprises curvature along its length.

In some embodiments, the sidewall of the second length portion is frustoconical.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
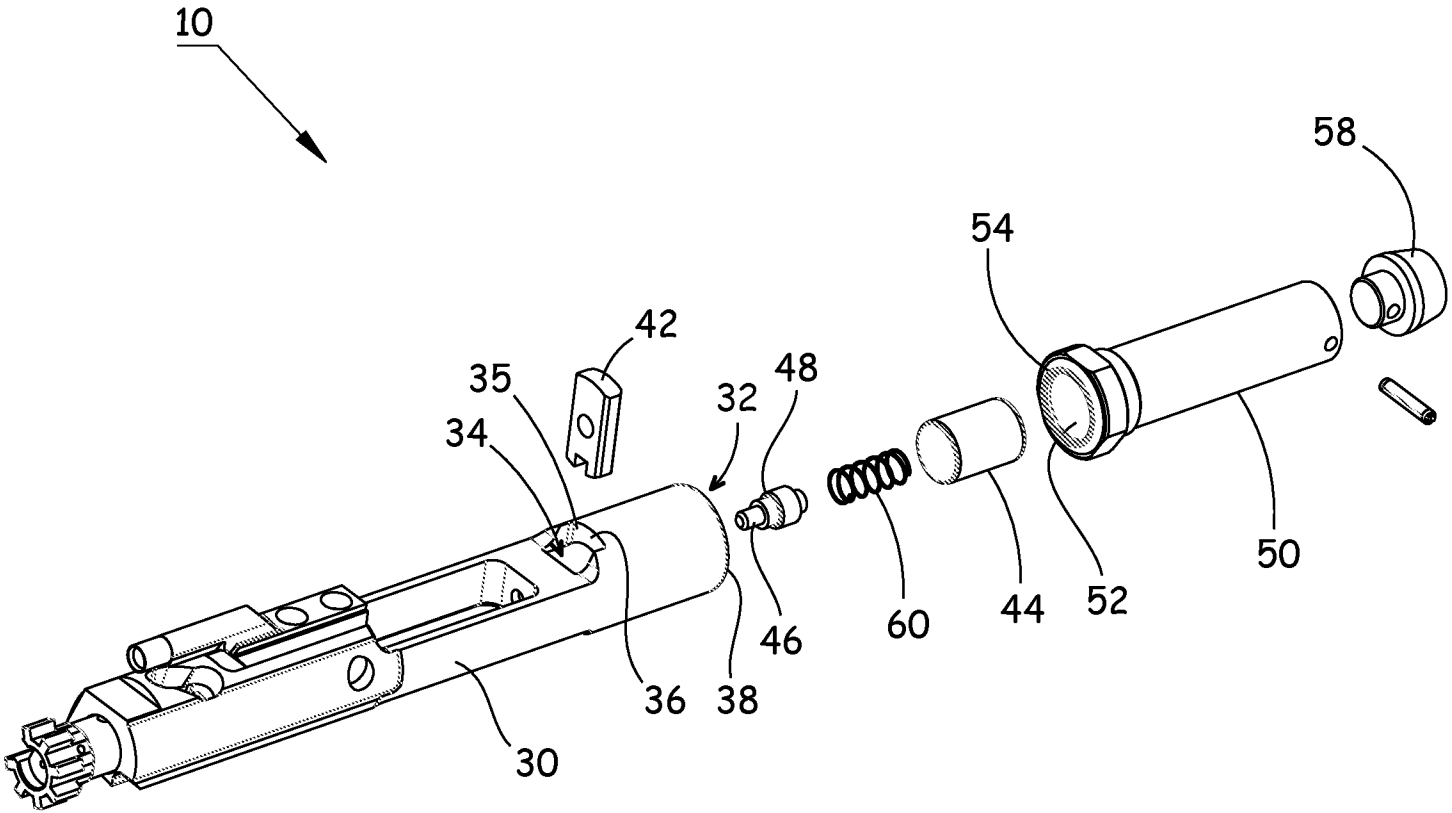
FIG. 1 shows an exploded view of an embodiment of a firearm delay mechanism.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

US Patent Application Publication No. 2018-0266782 teaches embodiments of a firearm delay mechanism. U.S. patent application Ser. No. 16/021,011, filed Jun. 27, 2018, teaches embodiments of a firearm delay mechanism. These references are hereby incorporated herein in their entireties.

FIG. 1 shows an embodiment of components that can be used in a firearm delay mechanism 10. In some embodiments, the parts of the firearm delay mechanism 10 are suitable for use in standard M4 and M16 firearms as drop-in replacement parts, without requiring any change to other parts of the firearm.

In some embodiments, a firearm delay mechanism 10 comprises a bolt carrier 30, a striker 42, at least one weight 44 and a buffer 50. In some embodiments, the striker 42 is carried by the bolt carrier 30. In some embodiments, the weight 44 is arranged to contact and move the striker 42, and the striker 42 can be arranged to operate an auto-sear of a firearm. In some embodiments, the buffer 50 comprises a cavity 52, and the weight 44 can be oriented in the cavity 52.

Figure 2:
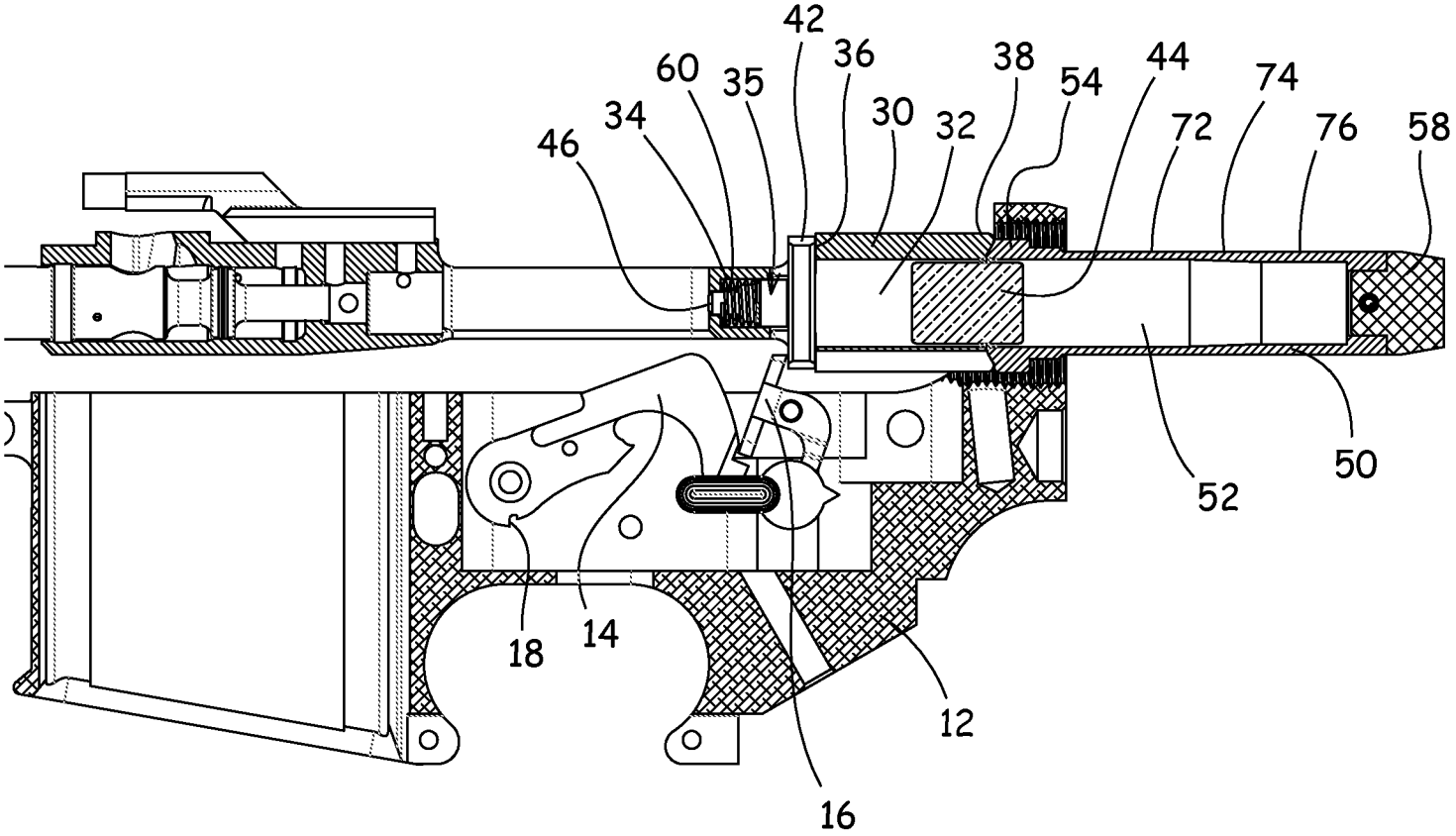
FIG. 2 shows a cross-sectional view of a portion of a firearm comprising an embodiment of a delay mechanism.

FIG. 2 shows an embodiment of a firearm delay mechanism 10 positioned with respect to an embodiment of a lower receiver 12. In some embodiments, the lower receiver 12 comprises a standard military specification M4 or M16 lower receiver. In some embodiments, a lower receiver 12 comprises a hammer 14 and an auto-sear 16. In some embodiments, the hammer 14 comprises a sear 18 arranged to contact the sear of a finger trigger (not illustrated). In some embodiments, the hammer 14 and auto-sear 16 comprise standard military specification parts.

In some embodiments, the striker 42 is moveable with respect to the bolt carrier 30 between first and second positions. In some embodiments, the striker 42 is biased to the first position by a biasing mechanism 60. In some embodiments, when the striker 42 is in its second position and the bolt carrier 30 is properly oriented with respect to the lower receiver 12, the striker 42 will operate the auto-sear 16 and fire a round.

In some embodiments, the bolt carrier 30 comprises a cavity 34 and a slot 35 arranged to support striker components. In some embodiments, a striker pin 46 is received in the cavity 34 and arranged to engage the striker 42. In some embodiments, the biasing mechanism 60 comprises a coil spring extending around the striker pin 46. In some embodiments, the striker pin 46 comprises a flange 48 arranged to engage the biasing mechanism 60. In some embodiments, the biasing mechanism 60 and striker pin 46 can be installed in the cavity 34, the biasing mechanism 60 can be compressed, and the striker 42 installed in the slot 35, wherein the engaging portion 47 of the striker pin 46 can engage the striker 42. The biasing mechanism 60 and striker pin 46 can bias the striker 42 against a flange 36 of the bolt carrier 30. In some embodiments, the striker 42 abuts the flange 36 when the striker 42 is in the first position with respect to the bolt carrier 30.

In some embodiments, the bolt carrier 30 comprises a cavity 32 arranged to receive the weight 44. In some embodiments, the cavity 32 is open to the rear end 38 of the bolt carrier 30. In some embodiments, the cavity 32 of the bolt carrier 30 is aligned with the cavity 52 of the buffer 50. In some embodiments, at least a portion of the weight 44 is arranged to travel between the cavity 52 of the buffer 50 and the cavity 32 of the bolt carrier 30.

In various embodiments, the weight 44 can have any suitable size, shape and configuration. A weight 44 having a shorter length can take more time to traverse the path from a rear of the buffer cavity 52 to the striker 42 than a weight 44 having a longer length. A weight 44 or assembly of weights 44 can occupy any suitable length portion of the buffer cavity 52 and/or the bolt carrier cavity 32. Weights 44 of different sizes can be used to adjust the specific timing delay of the delay mechanism 10.

A weight 44 can comprise any suitable material or combination of materials, such as metals, polymers, composite materials, etc. In some embodiments, a weight 44 comprises aluminum. In some embodiments, a weight 44 comprises steel. In some embodiments, a weight 44 comprises tungsten. Varying the mass of a weight 44 can change the time delay provided by the delay mechanism 10.

In some embodiments, the rear end 38 of the bolt carrier 30 and the front end 54 of the buffer 50 are arranged to engage one another and self-align. In some embodiments, the front end 54 of the buffer 50 comprises an inclined surface, peak or frustoconical surface 56 arranged to engage a complimentary shaped declined surface, valley or inverse frustoconical surface of the rear end 38 of the bolt carrier 30. The complimentary shaped ends 38, 54 desirably encourage the bolt carrier 30 and buffer 50 to align such that a central axis of the cavity 32 of the bolt carrier 30 is coaxial with a central axis of the cavity 52 of the buffer 50.

In some embodiments, the rear end 38 of the bolt carrier 30 is chamfered. In some embodiments, the front end 52 of the buffer 50 is chamfered. Chamfers can help the weight(s) 44 to pass smoothly across the transition between the bolt carrier cavity 32 and the buffer cavity 52.

In some embodiments, the buffer 50 comprises a bumper 58. In some embodiments, the bumper 58 is attached to the buffer 50 with a pin 59. In some embodiments, the bumper 58 comprises a contacting surface 64 arranged to contact the weight 44. In some embodiments, the bumper 58 comprises a back wall 78 of the buffer cavity 52.

In some embodiments, the striker 42 is positioned at an end of the bolt carrier cavity 32, and the weight 44 can contact the striker 42.

As the firearm is fired, the bolt carrier 30 and buffer 50 will traverse rearward with respect to the lower receiver 12. As the bolt carrier 30 and buffer 50 slow their rearward travel, for example being biased by a buffer spring (not illustrated), the weight 44 will continue traveling in the rearward direction, and will generally exit the bolt carrier cavity 32 and enter the buffer cavity 52, although the specific orientation is dependent upon the relative lengths of the weight 44 and the cavities 32, 52. The bolt carrier 30 and buffer 50 will come to a stop at the rear of their travel. The weight 44 will generally reach the rear of the buffer cavity 52. The bolt carrier 30 and buffer 50 will begin moving forward, still under the force of the buffer spring. The bolt carrier 30 and buffer 50 will stop when they reach their forward position (e.g. as shown in FIG. 2). The weight 44 continues traveling forward until it impacts the striker 42, which causes operation of the auto-sear 16 and the firearm to fire. A time interval between the bolt carrier 30 reaching its forward position and the weight 44 impacting the striker 42 amounts to a cycle rate delay caused by the delay mechanism 10. This type of operation is discussed further in US 2018-0266782.

It has been discovered that under certain conditions, the weight 44 can travel to the rear of the buffer 50 with enough energy to bounce off and begin traveling toward the striker 42 sooner than desired. This can cause the firing rate to be faster than desired.

Figure 3:
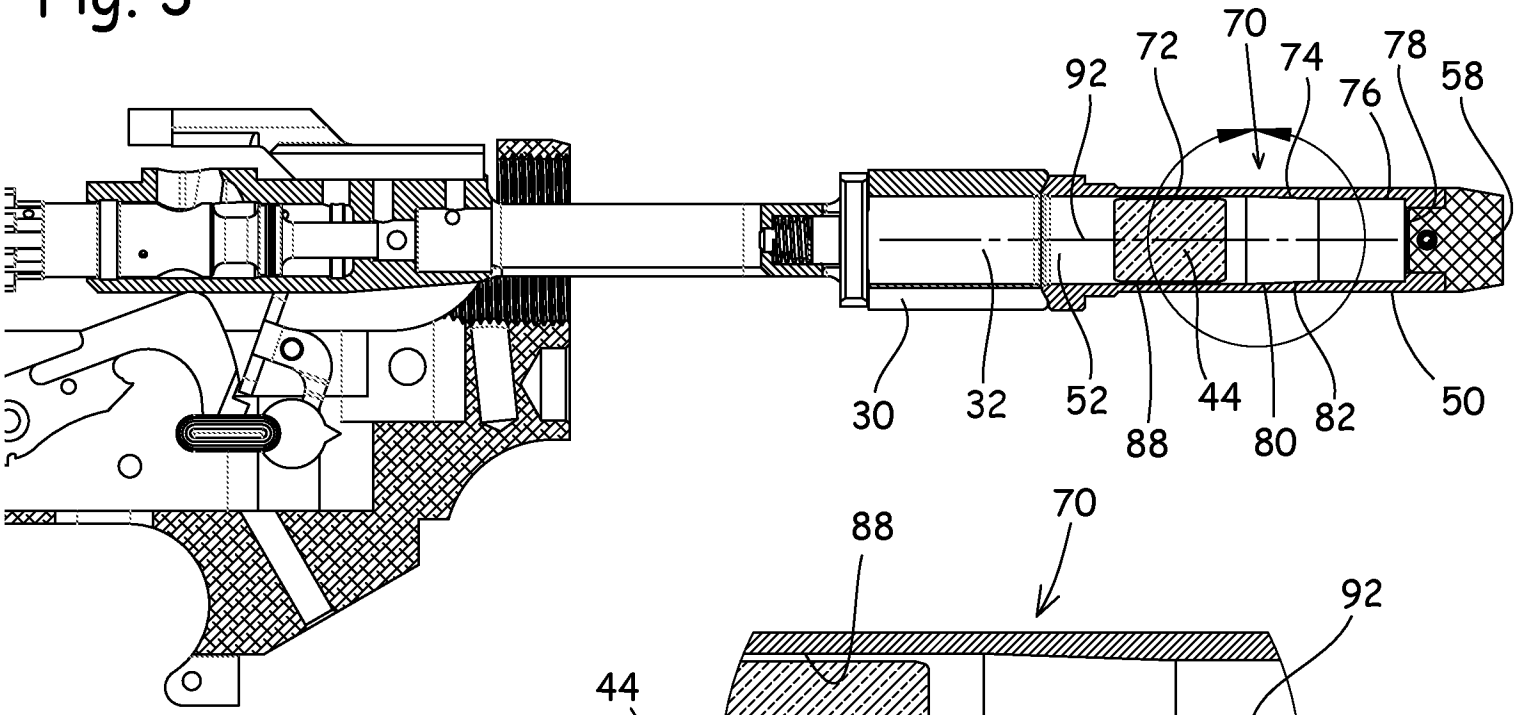
FIG. 3 shows an embodiment of a delay mechanism after firing.

FIG. 3 shows a bolt carrier 30 and buffer 50 after having been displaced rearward following a shot. The bolt carrier 30 and buffer 50 are slowing their rearward travel and the weight 44 continues to move rearward at a higher speed.

In some embodiments, the delay mechanism 10 comprises a damping mechanism 70 arranged to reduce the level of kinetic energy carried by the weight 44. In some embodiments, the delay mechanism 10 comprises a damping mechanism 70 arranged to reduce the velocity of the weight 44 with respect to the buffer 50. In some embodiments, the buffer 50 comprises the damping mechanism 70.

In some embodiments, a damping mechanism 70 comprises a narrowing of the cavity 52 of the buffer 50. In some embodiments, a damping mechanism 70 comprises a reduction in the cross-sectional area of the buffer cavity 52. In some embodiments, the cavity 52 and weight 44 are sized and shaped to use fluid (e.g. gasses) within the cavity 52 to reduce the speed and kinetic energy carried by the weight 44.

In some embodiments, the cavity 52 comprises a first portion 72 and a second portion 74. In some embodiments, the second portion 74 comprises the damping mechanism 70. In some embodiments, the cavity 52 comprises a third portion 76. In some embodiments, the second portion 74 is located between the first portion 72 and the third portion 76 along a length of the cavity 52.

In some embodiments, a cross-sectional area of the first portion 72 is substantially constant. In some embodiments, the first portion 72 is cylindrical in shape.

In some embodiments, the second portion 74 comprises a changing cross-sectional area. In some embodiments, the second portion 74 comprises a narrowing or taper. In some embodiments, the second portion 74 comprises a reduction in cross-sectional area as the second portion 74 is traversed. In some embodiments, the second portion 74 comprises a continuous reduction in cross-sectional area as the second portion 74 is traversed in direction toward the back wall 78 of the cavity 52. In some embodiments, the second portion 74 comprises a first location 80 having a first cross-sectional area and a second location 82 having a second cross-sectional area. In some embodiments, the second cross-sectional area is less than the first cross-sectional area, and the second location 82 is located closer to the back wall 78 of the cavity 52 than the first location 80.

In some embodiments, a cross-sectional area of the third portion 76 is substantially constant. In some embodiments, the third portion 76 is cylindrical in shape.

Figure 4:
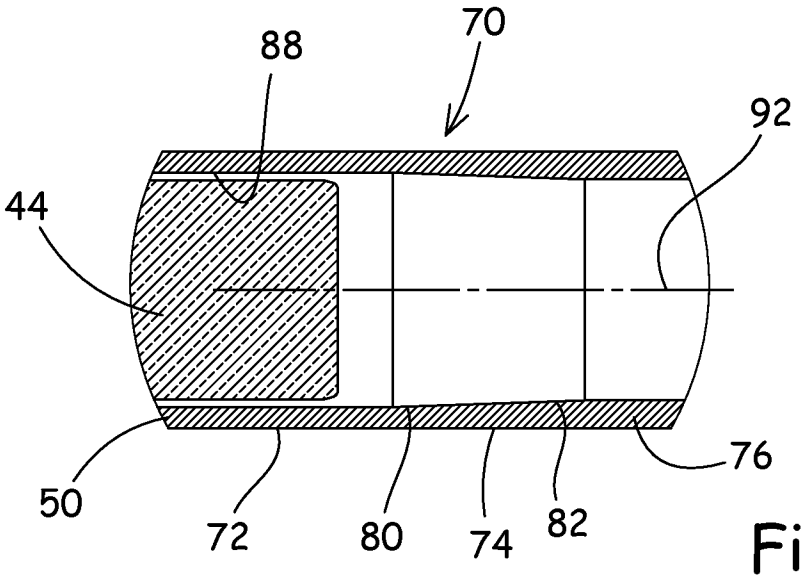
FIG. 4 shows a detail of components shown in FIG. 3.

FIG. 4 shows a portion of FIG. 3 in greater detail. In some embodiments, the weight 44 traverses the first portion 72 and the second portion 74 in sequence as it travels toward the back wall 78 of the cavity 52. As the weight 44 moves rearward, fluid from the rear of the cavity 52 passes by the weight 44, squeezing through a gap 88 between the weight 44 and the sidewall of the cavity 52. In some embodiments, as the weight 44 traverses the second portion 72, the available gap 88 for passing fluid is reduced.

Figure 5:
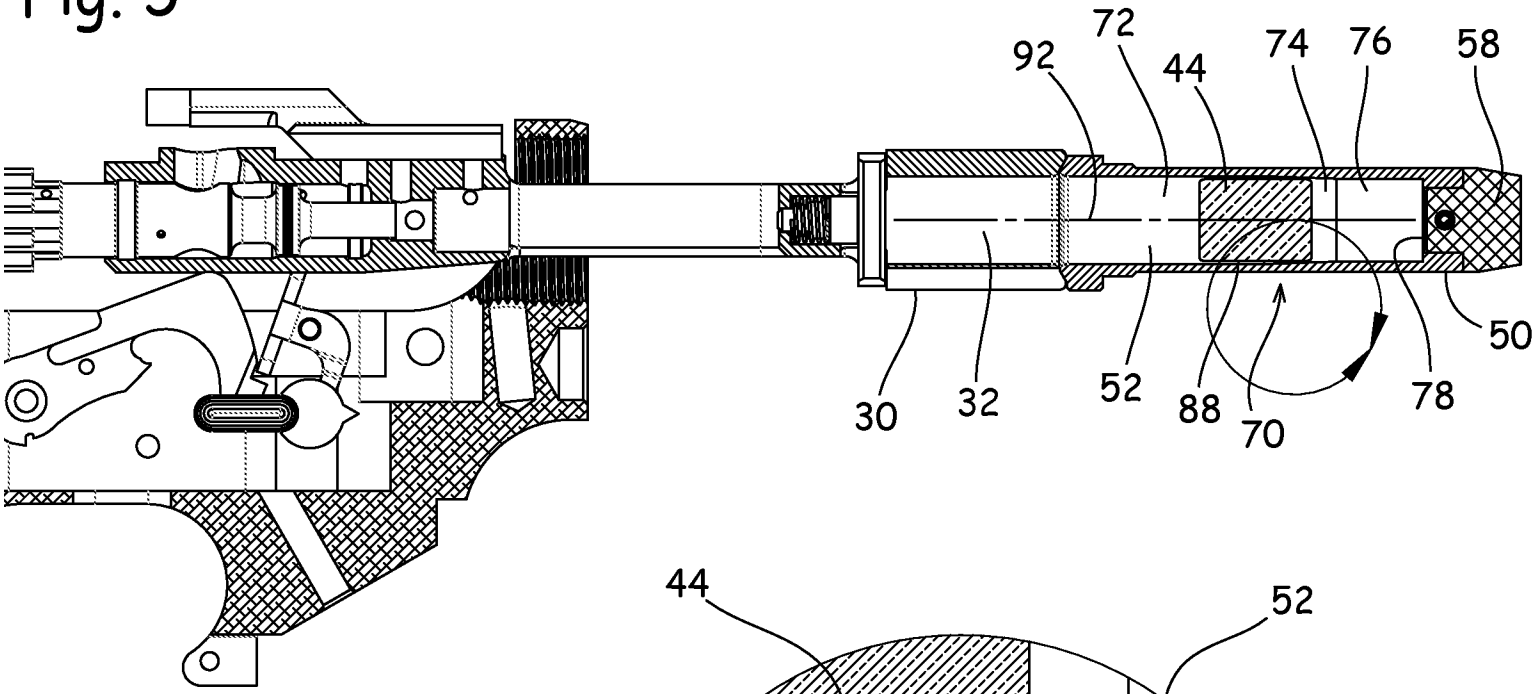
FIG. 5 shows the embodiment of FIG. 3 at a later stage of a firing sequence.
Figure 6:
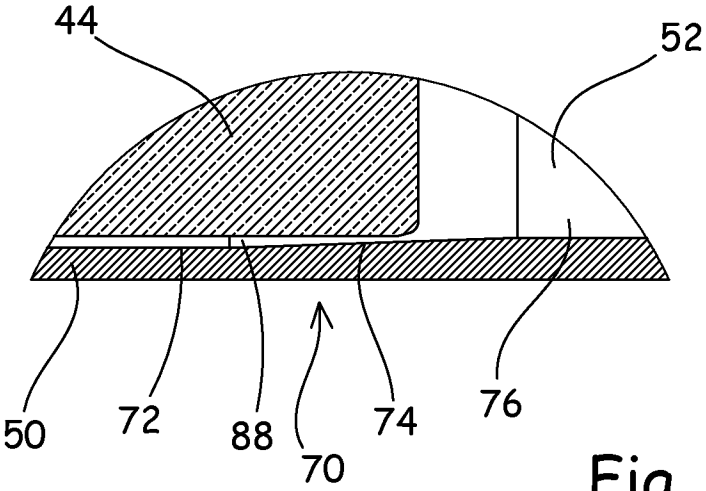
FIG. 6 shows a detail of components shown in FIG. 5.

FIGS. 5 and 6 show the same components as FIGS. 3 and 4, with a portion of the weight 44 passing into the second portion 72 of the cavity 52. As the weight 44 moves rearward and the gap 88 decreases in size, fluid behind the weight 44 will pressurize. The pressure works to damp the weight 44, reducing its energy level and speed of travel.

In some embodiments, a reduction in cross-sectional area of the cavity 52 comprises a damping mechanism 70 that provides varying levels of damping in response to the speed of the weight 44. When the speed of the weight 44 is higher, the damping mechanism 70 provides a greater amount of damping.

In some embodiments, the damping mechanism 70 and the weight 44 comprise a valve mechanism arranged to pressurize the buffer cavity 52.

In some embodiments, the first and second portions 72, 74 of the buffer 50 comprise adjacent length portions. In some embodiments, the first portion 72 is adjacent to the bolt carrier 30. In some embodiments, the first portion 72 comprises a first cross-sectional size. In some embodiments, the first portion 72 comprises a first diameter. In some embodiments, the first portion 72 comprises a cylindrical portion. In some embodiments, the first portion 72 comprises a cross-sectional size and shape that is similar to the cavity 32 of the bolt carrier 30.

In various embodiments, the second portion 74 can have any suitable size, shape and configuration. Desirably, the second portion 74 comprises a damping mechanism 70. In some embodiments, one or more contours in the sidewall of the cavity 52 at the second portion 74 comprise a damping mechanism 70. In some embodiments, the damping mechanism 70 comprises a reduction in the size of the second portion 74. In some embodiments, the damping mechanism 70 comprises a reduction in the cross-sectional area of the second portion 74. In some embodiments, a surface of the sidewall of the second portion 74 of the cavity 52 is angled with respect to a central axis 92 of the cavity 52. In some embodiments, the sidewall comprises an inclined portion that is oriented at a non-zero angle to the central axis 92. In some embodiments, the inclined portion comprises a straight or linear lengthwise surface. In some embodiments, a slope of the sidewall of the second portion 74 is constant in the lengthwise direction.

As shown in FIGS. 3-6, in some embodiments, the second portion 74 comprises a frustoconical shape that provides a gradual and constant reduction in cross-sectional area as the second portion 74 is traversed.

In some embodiments, the second portion 74 comprises more complex changes in shape. For example, in some embodiments, the inner sidewall of the second portion 74 comprises curvature. In some embodiments, a slope of the sidewall of the second portion 74 is not constant, but varies as the second portion 74 is traversed. In some embodiments, the sidewall of the second portion 74 comprises a portion that is longitudinally concave with respect to the central axis 92. In some embodiments, the sidewall of the second portion 74 comprises a portion that is longitudinally convex with respect to the central axis 92. In some embodiments, a slope of the sidewall of the second portion 74 comprises an inflection.

In some embodiments, the cavity 52 comprises a third portion 76 located rearward of the second portion 74. The third portion 76 can have any suitable shape. In some embodiments, the third portion 76 comprises a constant cross-sectional size. In some embodiments, the third portion 76 comprises a cylindrical portion.

In some embodiments, the third portion 76 comprises a cross-sectional size that is less than the cross-sectional size of the first portion 72. In some embodiments, the third portion 76 comprises a diameter that is less than a diameter of the first portion 72.

In some embodiments, a cross-sectional shape of the buffer cavity 52 is constant and a cross-sectional size of the buffer cavity 52 changes along the length of the buffer cavity 52. In some embodiments, a cross-sectional size of the buffer cavity 52 changes along the length of the second portion 74.

In some embodiments, an inner sidewall of the first portion 72 extends parallel to a central axis of the buffer 50. In some embodiments, an inner sidewall of the second portion 74 extends at an angle to the central axis of the buffer 50. In some embodiments, an inner sidewall of the third portion 76 extends parallel to the central axis of the buffer 50. In some embodiments, a central axis 92 of each of the first, second and third portions 72, 74, 76 is collinear with the central axis of the buffer 50.

The second portion 74 can extend for any suitable length portion of the cavity 52. A tapered sidewall of the second portion 74 can extend for any suitable length portion of the cavity 52. A second portion 74 can be located anywhere along the length of the cavity 52. A damping mechanism 70 can be located anywhere along the length of the cavity 52.

In some embodiments, the second portion 74 comprises a length that is less than shown in FIG. 5. In some embodiments, the second portion 74 comprises a length that greater than shown in FIG. 5. In some embodiments, the second portion 74 can span a majority of the length of the cavity 52.

An inclined portion of the sidewall of the second portion 74 can be oriented at any suitable angle to the central axis 92. In some embodiments, the angle is between 0.1 degrees and 10 degrees. In some embodiments, the angle is between 3 degrees and 5 degrees. As shown in FIG. 6, the sidewall of the second portion 74 comprises an inclined portion oriented at approximately 4 degrees with respect to the central axis 92.

In a working embodiment as illustrated in FIG. 5, an inner diameter of the first portion 72 is 0.610 in, an inner diameter of the third portion 76 is 0.575 in and the second portion 74 comprises a continuous and constant reduction in diameter from 0.610 in to 0.575 in. An outer diameter of the weight 44 is 0.570 in. When the weight 44 is centered in the first portion 72, a gap 88 of 0.020 in is formed around the weight 44. When the weight 44 is centered in the third portion 76, a gap 88 of 0.0025 in is formed around the weight 44. The weight 44 has a length of 0.775 in. The third portion 76 has a length of 0.6 in from the back wall 78 to the second portion 74. The second portion 74 has a length of 0.5 in. The second portion 74 comprises a sidewall that is angled at 4 degrees to the central axis 92.

Figure 7:
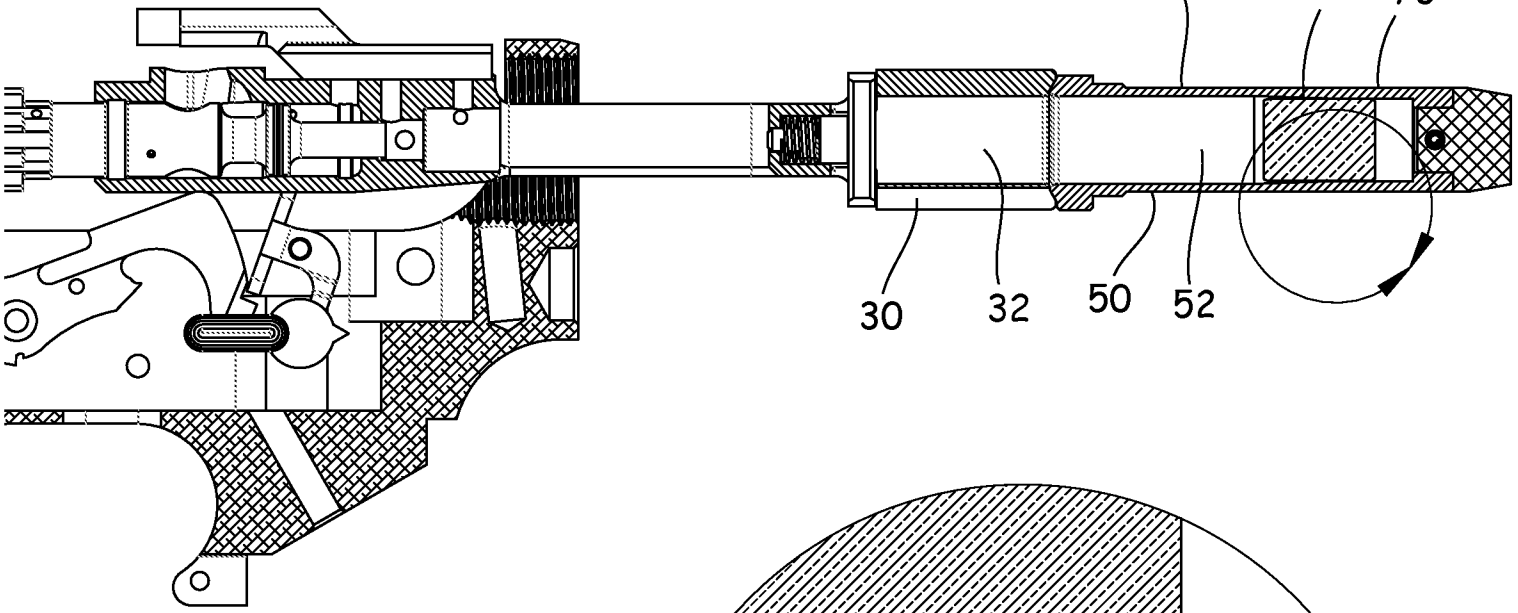
FIG. 7 shows the embodiment of FIG. 5 at a later stage of a firing sequence.
Figure 8:
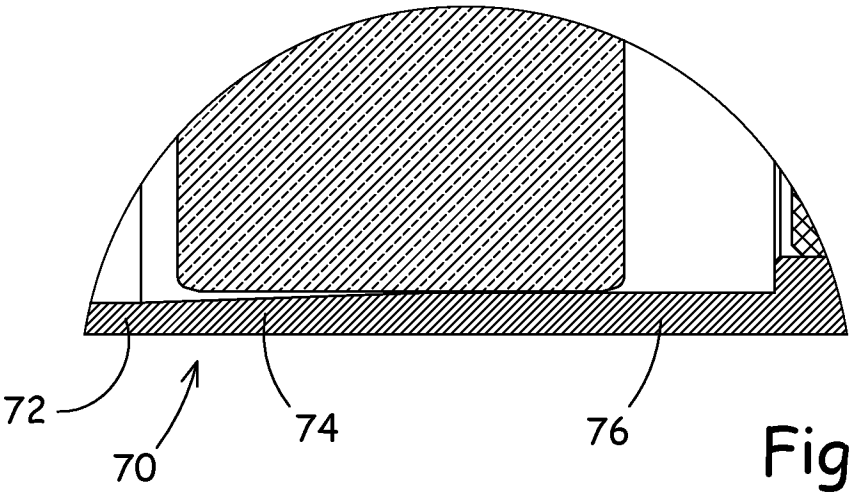
FIG. 8 shows a detail of components shown in FIG. 7.

FIGS. 7 and 8 show the weight 44 as it travels through the second portion 74 and into the third portion 76. The speed and energy level of the weight 44 has been reduced by the damping mechanism 70. In some embodiments, the damping mechanism 70 prevents the weight 44 from impacting and bouncing off the back wall 78 of the cavity 52.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A firearm mechanism comprising:
a bolt carrier comprising a bolt carrier cavity;
a buffer comprising a buffer cavity; and
a weight arranged to travel between the bolt carrier cavity and the buffer cavity;
wherein the buffer cavity comprises a damping mechanism comprising a reduction in a cross-sectional size of the buffer cavity.

2. The firearm mechanism of claim 1, wherein the damping mechanism and weight comprise a valve arrangement arranged to pressurize the buffer cavity.

3. The firearm mechanism of claim 1, the buffer cavity comprising a first portion and a second portion, the first portion adjacent to the bolt carrier cavity, the second portion comprising the damping mechanism.

4. The firearm mechanism of claim 3, the second portion comprising a taper.

5. The firearm mechanism of claim 3, wherein the reduction in the cross-sectional size is continuous along a length of the second portion.

6. The firearm mechanism of claim 3, wherein a rate of the reduction in the cross-sectional size is constant along a length of the second portion.

7. The firearm mechanism of claim 3, wherein the first portion is cylindrical.

8. The firearm mechanism of claim 3, the buffer cavity comprising a third portion, the second portion located between the first portion and the third portion.

9. The firearm mechanism of claim 8, the third portion comprising a smaller cross-sectional size than the first portion.

10. A firearm mechanism comprising:
a bolt carrier comprising a bolt carrier cavity;
a buffer comprising a buffer cavity; and
a weight arranged to travel between the bolt carrier cavity and the buffer cavity;
wherein the buffer cavity comprises a tapered portion.

11. The firearm mechanism of claim 10, wherein the tapered portion and weight comprise a valve arrangement arranged to pressurize the buffer cavity.

12. The firearm mechanism of claim 10, the buffer cavity comprising a first portion and a second portion, the first portion adjacent to the bolt carrier cavity, the second portion comprising the tapered portion.

13. The firearm mechanism of claim 10, wherein a cross-sectional shape of the buffer cavity is constant.

14. The firearm mechanism of claim 10, wherein a cross-sectional area of the tapered portion is continuously reduced along a length of the tapered portion.

15. A firearm buffer comprising:
a body comprising a sidewall defining a cavity, the cavity comprising a first length portion, a second length portion and a third length portion, the third length portion comprising a cross-sectional area that is less than a cross-sectional area of the first length portion, the second length portion comprising a reduction in cross-sectional area;
wherein the sidewall of the second length portion is frustoconical.

16. A firearm buffer comprising:
a body comprising a sidewall defining a cavity, the cavity comprising a first length portion, a second length portion and a third length portion, the third length portion comprising a cross-sectional area that is less than a cross-sectional area of the first length portion, the second length portion comprising a reduction in cross-sectional area;
wherein the sidewall of the second length portion comprises curvature along its length.

17. The firearm buffer of claim 15, wherein a central axis of the first length portion is coaxial with a central axis of the second length portion and with a central axis of the third length portion.

18. The firearm buffer of claim 15, further comprising a weight arranged to traverse the cavity.

19. The firearm buffer of claim 18, wherein the reduction in cross-sectional area and the weight comprise a valve arrangement arranged to pressurize the cavity.

* * * * *